US011061350B2

(12) United States Patent
Takahira et al.

(10) Patent No.: US 11,061,350 B2
(45) Date of Patent: Jul. 13, 2021

(54) IMAGE FORMING APPARATUS

(71) Applicant: FUJIFILM Business Innovation Corp., Tokyo (JP)

(72) Inventors: Kazuya Takahira, Kanagawa (JP); Shoji Yamauchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/844,448

(22) Filed: Apr. 9, 2020

(65) Prior Publication Data

US 2021/0096495 A1 Apr. 1, 2021

(30) Foreign Application Priority Data

Oct. 1, 2019 (JP) ..... JP2019-181464

(51) Int. Cl.
*G03G 15/00* (2006.01)

(52) U.S. Cl.
CPC ..... *G03G 15/5058* (2013.01); *G03G 15/556* (2013.01)

(58) Field of Classification Search
CPC ..... G03G 15/5041; G03G 15/5054; G03G 15/5058; G03G 15/556
See application file for complete search history.

(56) References Cited

U.S. PATENT DOCUMENTS

2010/0231934 A1* 9/2010 Takagaki ..... G03G 15/0131 358/1.9
2011/0052229 A1* 3/2011 Shishikura ..... G03G 15/0131 399/49
2012/0155894 A1* 6/2012 Kim ..... G03G 15/5058 399/31
2013/0243458 A1* 9/2013 Suzuki ..... G03G 15/5033 399/49

FOREIGN PATENT DOCUMENTS

JP 4820067 B2 11/2011

* cited by examiner

*Primary Examiner* — Carla J Therrien
(74) *Attorney, Agent, or Firm* — Sughrue Mion, PLLC

(57) ABSTRACT

An image forming apparatus includes a density detector, a determination unit, and a change unit. The density detector detects a density of a patch image formed on an image carrier over plural places. The determination unit determines whether plural detection results of the density detector are within a threshold. When the number of determination results, by the determination unit, that the density of the patch image is not within the threshold exceeds a predetermined number, the change unit changes (i) a detection timing at which the patch image is detected by the density detector or (ii) a formation position of the patch image on the image carrier.

9 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2019-181464 filed Oct. 1, 2019.

BACKGROUND

1. Technical Field

The present disclosure relates to an image forming apparatus.

2. Related Art

In the related art, an image forming apparatus is configured to form a patch image on an image carrier and control an image density by detecting a density of the patch image in order to appropriately maintain the image density (JP-B-4820067 and the like). JP-B-4820067 discloses a technique in which only a patch pattern detection result of a central portion area of the patch pattern is selected from among patch pattern detection results stored in a storage unit from a positional deviation amount of the patch pattern and an image density of the patch pattern is calculated by a density calculation unit.

SUMMARY

Aspects of non-limiting embodiments of the present disclosure relate to securing the number of patch images effective for density detection even when a margin set before and after a detection area of the patch image is narrowed, as compared with a case where only a detection result of a central portion area is selected from among detection results of the patch image stored in a storage unit based on a positional deviation amount of the patch image to calculate an image density of the patch image.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a density detector, a determination unit, and a change unit. The density detector detects a density of a patch image formed on an image carrier over plural places. The determination unit determines whether plural detection results of the density detector are within a threshold. When the number of determination results, by the determination unit, that the density of the patch image is not within the threshold exceeds a predetermined number, the change unit changes (i) a detection timing at which the patch image is detected by the density detector or (ii) a formation position of the patch image on the image carrier.

BRIEF DESCRIPTION OF THE DRAWINGS

Exemplary embodiment(s) of the present disclosure will be described in detail based on the following figures, wherein.

DETAILED DESCRIPTION

Exemplary embodiments of the present disclosure will be described below with reference to the drawings.

First Exemplary Embodiment

Figure 1:
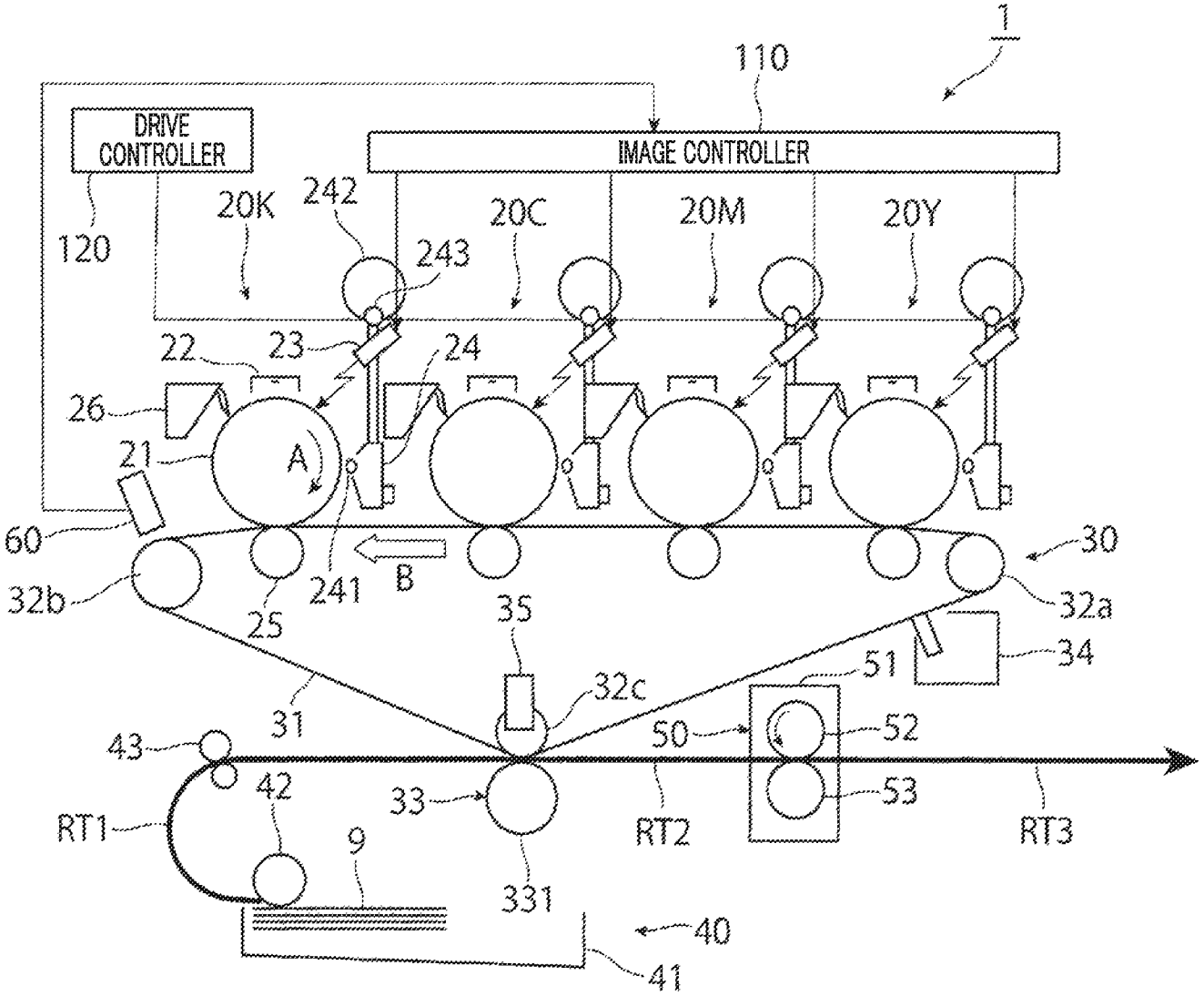
FIG. 1 is a schematic configuration diagram illustrating an image forming apparatus according to a first exemplary embodiment of the present disclosure.

FIG. 1 illustrates an image forming apparatus according to a first exemplary embodiment.

Overall Configuration of Image Forming Apparatus

An image forming apparatus 1 is a full-color printer that finally forms an image with toner on recording paper 9 based on image information composed of characters, photographs, figures, and the like by adopting an electrophotographic process. The recording paper 9 is an example of a recording medium. In the image forming apparatus 1, as illustrated in FIG. 1, an image forming device 20 as an example of an image forming unit that forms a toner image with toner as a developer, an intermediate transfer device 30 that holds the toner image formed by the image forming device 20 by being subjected to primary transfer, and then transports the toner image to a secondary transfer position where the toner image is secondarily transferred onto the recording paper 9, a paper feeding device 40 that accommodates and supplies the recording paper 9 to be supplied to the secondary transfer position of the intermediate transfer device 30, and a fixing device 50 that fixes the toner image secondarily transferred by the intermediate transfer device 30 to the recording paper 9 are disposed. A thick solid line illustrated in FIG. 1 is a transport path of the recording paper 9.

The image forming device 20 includes four image forming devices 20Y, 20M, 20C and 20K that individually form developer (toner) images of four colors of yellow (Y), magenta (M), cyan (C), and black (K). As illustrated in FIG. 1, each of the image forming devices 20 (Y, M, C, and K) include a photoconductor drum 21 that is driven to rotate in a direction indicated by an arrow A. The photoconductor drum 21 is an example of an image carrier. Around each photoconductor drum 21, a charging device 22, an exposure device 23, a developing device 24, a primary transfer device 25, a drum cleaning device 26, and the like are disposed. The reference numerals of the photoconductor drum 21 and the members disposed around the photoconductor drum 21 are assigned only to image forming device 20K of black (K), and are omitted in the other image forming devices 20 (Y, M, and C).

The photoconductor drum 21 is, for example, a drum-shaped photoconductor in which an image-forming surface having a photo-dielectric layer (photoconductive layer) made of a photosensitive material such as OPC is formed on a peripheral surface of a cylindrical or columnar conductive base material to be grounded. The photoconductor drum 21 is rotatably driven in a direction indicated by the arrow A by receiving power from a driving device (not illustrated).

As the charging device 22, for example, a non-contact type charging device such as a scorotron, which is disposed in a non-contact state on an image-forming surface of the photoconductor drum 21 and is supplied with required charging bias of a negative polarity, is used. The charging device 22 is not limited to a non-contact type charging device such as a scorotron, but may use a contact type charging device provided with a charging roller.

The exposure device 23 is, for example, a non-scanning type exposure device configured using a light emitting diode and an optical component, or a scanning type exposure device configured using an optical component such as a semiconductor laser and a polygon mirror. The exposure device 23 receives each image information, which is input from the outside through a communication unit, an image reading device, or the like, or image information stored in an internal storage, as an image signal separated into respective color components (Y, M, C, and K) of yellow (Y), magenta (M), cyan (C), and black (K) after being subjected to required processing by an image controller 110. The exposure device 23 performs exposure according to the input image signal.

The developing device 24 is, for example, a developing device 24 (Y, M, C, and K) that uses a two-component developer containing a toner of one of the four colors (Y, M, C, and K) and a magnetic carrier. The developing device 24 (Y, M, C, and K) is used, for example, to charge the toner to a negative polarity to perform reversal development. The developing device 24 (Y, M, C, and K) includes a developing roller 241 that is stored in a casing, holds the two-component developer, and rotates so as to transport the two-component developer to a developing area facing the photoconductor drum 21. The developing roller 241 is an example of a developer holding unit. The developing roller 241 is supplied with the developing bias in which, for example, a DC component is superimposed on an AC component between the developing roller 241 and the photoconductor drum 21.

Each of the developing devices 24 (Y, M, C, and K) of yellow (Y), magenta (M), cyan (C), and black (K) is supplied with a toner of the corresponding color from the toner cartridge 242 containing the corresponding color toner by rotating a supply motor 243 as a developer supply driving unit. The drive timing and the drive time of each supply motor 243 are controlled by a drive controller 120. In each of the developing device 24 (Y, M, C, and K), appropriate supply of the corresponding color toner from the toner cartridge 242 changes the toner concentration in the developing device 24 (Y, M, C, and K). The image controller 110 and the drive controller 120 are implemented by, for example, a controller 101 of a control device 100 described later.

The primary transfer device 25 is, for example, disposed so as to be in contact with an image-forming surface portion (in a state via an intermediate transfer belt 31 described later), which is a primary transfer position of the photoconductor drum 21 and to be driven to rotate, and is a contact type transfer device including a primary transfer roller to which a required primary transfer bias is supplied.

The drum cleaning device 26 is disposed so as to be in contact with at least the image-forming surface portion of the photoconductor drum 21 after the primary transfer at an opening for clean work of the casing, and includes a cleaning member such as an elastic plate that scrapes and removes unnecessary matters such as residual toner on the image-forming surface.

The intermediate transfer device 30 is disposed at a position below the four image forming devices 20 (Y, M, C, and K). The intermediate transfer device 30 includes an intermediate transfer belt 31 disposed that rotates in a direction indicated by an arrow B while passing through primary transfer positions facing the primary transfer device 25 of the photoconductor drum 21 respectively in the image forming device 20 (Y, M, C, and K). The intermediate transfer belt 31 is an example of an intermediate transfer unit (image carrier). The intermediate transfer belt 31 is an image carrier that holds a patch image 200 described later formed by each of the image forming devices 20 (Y, M, C, and K) of yellow (Y), magenta (M), cyan (C), and black (K).

The intermediate transfer belt 31 is formed into an endless belt shape having a required thickness and electric resistance value by using a material obtained by dispersing a resistance adjusting agent such as carbon black on a base material such as polyimide resin or polyamide-imide resin.

The intermediate transfer belt 31 is stretched around plural support rollers 32*a* to 32*c* and is rotatably supported. The support roller 32*a* serves as a driving roller. The support roller 32*b* is configured as a sensor roller that supports the intermediate transfer belt 31 wound around an outer peripheral surface thereof and detects a patch image as a density control image formed on the intermediate transfer belt 31 by a density sensor 60. The density sensor 60 is an example of a density detector. The support roller 32*c* is configured as a secondary transfer backup roller. The density sensor 60 is disposed at a position facing the surface of the intermediate transfer belt 31, and is disposed downstream of the downstreammost image forming device 20K of black (K) in a moving direction of the intermediate transfer belt 31 among the four image forming devices 20 (Y, M, C, and K) of yellow (Y), magenta (M), cyan (C), and black (K).

Figure 2:
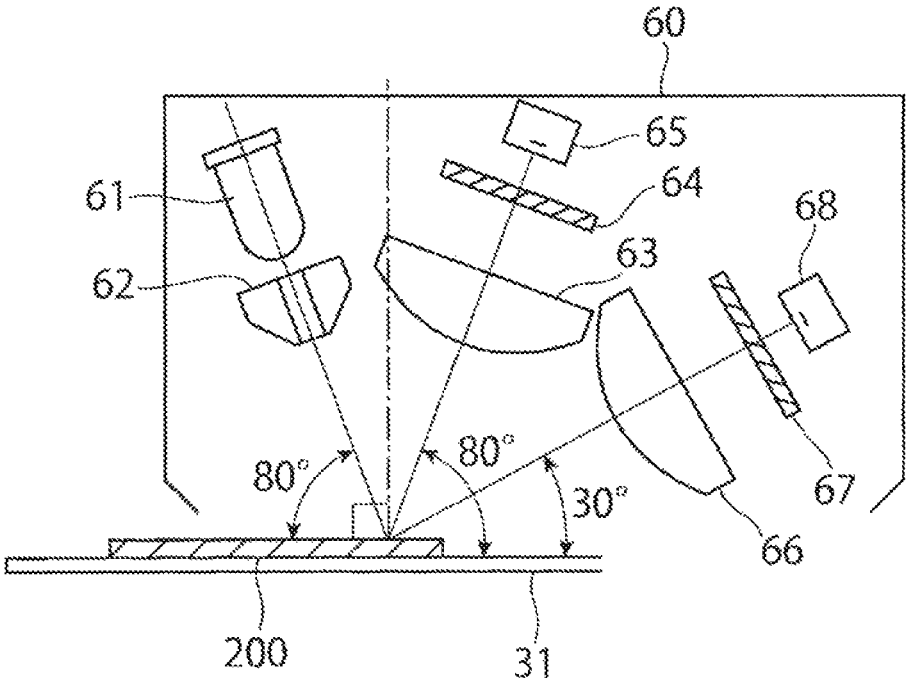
FIG. 2 is a cross-sectional configuration diagram illustrating a density sensor of the image forming apparatus according to the first exemplary embodiment of the present disclosure.

FIG. 2 is a configuration diagram illustrating an optical density sensor.

As illustrated in FIG. 2, the density sensor 60 includes a light emitting element 61 made of an LED or the like, a light shielding member 62 that irradiates an exposure position on the intermediate transfer belt 31 with the light flux, which is emitted from the light emitting element 61, to be focused in a substantially circular shape, a first condensing lens 63 that collects specularly reflected light from the patch image 200 formed on the intermediate transfer belt 31, a first ultraviolet light cut filter 64 that blocks ultraviolet light, a first light receiving element 65 implemented by a photodiode, a phototransistor, and the like that receives the specularly reflected light from the patch image 200 formed on the intermediate transfer belt 31 through the first condensing lens 63 and the first ultraviolet light cut filter 64, a second condensing lens 66 that collects diffuse reflection light from the patch image 200 formed on the intermediate transfer belt 31, a second ultraviolet light cut filter 67 that blocks ultraviolet light, and a second light receiving element 68 implemented by a photodiode, a phototransistor, and the like that receives the diffuse reflection light from the patch image 200 formed on the intermediate transfer belt 31 through the second condensing lens 66 and the second ultraviolet light cut filter 67. An incident angle of the light emitting element 61 is set to about 80 degrees with respect to the patch image 200 on the intermediate transfer belt 31, for example. Further, a light receiving angle of the first light receiving element 65 is about 80 degrees in order to receive specularly reflected light from the patch image 200 on the intermediate transfer belt 31. On the other hand, the light receiving angle of the second light receiving element 68 is set to about 30 degrees, for example, to receive diffuse reflection light from the patch image 200 on the intermediate transfer belt 31. The detection signal from the density sensor 60 is input to the image controller 110 as illustrated in FIG. 1. The detection signal (sensor value) of the density sensor 60 is obtained by subjecting output signals from the first and second light receiving elements 65 and 68 to required arithmetic processing, and decreases as the toner amount of the patch image 200 increases.

The intermediate transfer device 30 includes a secondary transfer device 33 that secondarily transfers the toner image, which is transferred on the intermediate transfer belt 31, to the recording paper 9, and a belt cleaning device 34 that removes and cleans unnecessary matters such as the toner remaining on and attached to the image carrying surface on the outer peripheral surface of the intermediate transfer belt 31, and the like. The secondary transfer device 33 is an example of a transfer unit. The belt cleaning device 34 is an example of a cleaner for the intermediate transfer device 30.

As the secondary transfer device 33, as illustrated in FIG. 1, for example, a contact type transfer device including a secondary transfer roller 331, which is disposed to rotate in contact with an image carrying surface portion supported by the support roller 32*c* of the intermediate transfer belt 31 during normal image-forming, is employed. A secondary transfer voltage having the same polarity or opposite polarity to a charged polarity of the toner is applied to the support roller 32*c* or the secondary transfer roller 331 that supports the intermediate transfer belt 31 from the back surface by a power supply (not illustrated). The support roller 32*c* or the secondary transfer roller 331 that supports the intermediate transfer belt 31 from the back surface is configured so that the secondary transfer roller 331 can be brought into contact with and separated from the intermediate transfer belt 31 by a contact and separation unit 35. When a patch image is formed on the intermediate transfer belt 31, the secondary transfer roller 331 is separated from the intermediate transfer belt 31 by the contact and separation unit 35.

The belt cleaning device 34 is disposed so as to be in contact with at least the image carrying surface portion of the intermediate transfer belt 31 after the secondary transfer at the opening for cleaning work of the casing, and includes a cleaning member such as an elastic plate that scrapes and cleans unnecessary matters such as residual toner on the image carrying surface.

The paper feeding device 40 is disposed at a position below the intermediate transfer device 30. The paper feeding device 40 includes a storage body 41 in which the recording paper 9 of a required size, type, and the like is stored in a stacked state on a loading plate (not illustrated), and a delivery device 42 that delivers the recording paper 9 one by one from the storage body 41 toward the paper feeding transport path. The number of the storage bodies 41 and the delivery devices 42 is increased or decreased as needed.

The recording paper 9 can be applied to any recording medium which can be transported by a transport path and onto which a toner image can be transferred and fixed. Examples of the recording paper 9 include thin paper such as plain paper and tracing paper used in an electrophotographic copier and a printer, or an OHP sheet. In order to further improve smoothness of the image surface after fixing, the surface of the recording paper 9 is desirably as smooth as possible, and, for example, so-called thick paper having a relatively large basis weight, such as coated paper in which the surface of plain paper is coated with a resin or the like, art paper for printing, and the like can be suitably used.

The fixing device 50 is disposed below the intermediate transfer device 30 in the transport direction of the recording paper 9 near the secondary transfer position. The fixing device 50 is installed with a heating rotating body 52 having a shape of a roller or a belt that rotates inside the casing 51 in a direction indicated by an arrow and is heated by a heating unit so that the surface temperature is maintained at a predetermined temperature, and a pressurizing rotating body 53 in the form of a roller or a belt that is driven and rotated in contact with a predetermined pressure in a state of running substantially along the axial direction of the heating rotating body 52. In the fixing device 50, a portion where the heating rotating body 52 and the pressurizing rotating body 53 are in contact is configured as a fixing processing unit where the recording paper 9 holding the toner image is introduced and is subjected to fixing processing (heating and pressing).

The image forming apparatus 1 is provided with a supply transport path RT1 connecting between the paper feeding device 40 and the intermediate transfer device 30, a relay transport path RT2 connecting between the secondary transfer position of the intermediate transfer device 30 and the fixing device 50, and an output transport path RT3 connecting between the fixing device 50 and a paper output port (not illustrated) as paper transport paths for the recording paper 9.

In the supply transport path RT1, one or plural paper transport roller pairs 43 for transporting the recording paper 9 supplied from the paper feeding device 40 to the secondary transfer position, a transporting guide (not illustrated), and the like are disposed. The paper transport roller pair 43 disposed adjacent to the intermediate transfer belt 31 upstream of the secondary transfer position is configured as a registration roller that transports the recording paper 9 in synchronization with an image on the intermediate transfer belt 31.

Basic Image Forming Operation by Image Forming Apparatus

In the image forming apparatus 1, a basic image forming operation described below is performed. Here, an operation in the case of forming a full-color image formed by combining toner images of four colors (Y, M, C, K) will be described as an example.

First, in the image forming apparatus 1, as illustrated in FIG. 1, when the control device 100 (see FIG. 5) receives a request command for an image forming operation from outside or the like, each photoconductor drum 21 is driven to rotate in the direction indicated by arrow A and each charging device 22 receives a supply of a charging current and generates a corona discharge, in the four image forming devices 20 (Y, M, C, and K). With this configuration, the image-forming surface of each photoconductor drum 21 is charged to a required polarity (for example, a negative polarity) and a potential.

Subsequently, each exposure device 23 performs exposure on the image-forming surface of each photoconductor drum 21 after charging according to the image signal decomposed into each of the color components (Y, M, C, and K). With this configuration, an electrostatic latent image of each color component having a predetermined potential is formed on the image-forming surface of each photoconductor drum 21.

Subsequently, each of the developing devices 24 (Y, M, C, and K) supplies the toner of each of colors (Y, M, C, and K) charged to a predetermined polarity (negative polarity) from a developing roller 241, and electrostatically adheres the toner to an electrostatic latent image portion of each color component on the image-forming surface of the photoconductor drum 21 by a developing electric field formed between the developing roller 241 and the photoconductor drum 21 by receiving the supply of a developing bias. With this configuration, a toner image of a corresponding color among the four colors (Y, M, C, and K) is individually formed on the image-forming surface of each photoconductor drum 21.

Subsequently, each primary transfer device 25 receives the supply of the primary transfer current and forms a primary transfer electric field between the primary transfer device 25 and the photoconductor drum 21, so that the toner image on each photoconductor drum 21 is primarily transferred to the image carrying surface of the intermediate transfer belt 31 in the intermediate transfer device 30 in order (in the order of Y, M, C, and K). The drum cleaning device 26 cleans the image-forming surface of each photoconductor drum 21 after the primary transfer or the like, and prepares for the next image creating operation in each photoconductor drum 21.

Next, in the intermediate transfer device 30, an unfixed toner image primarily transferred and held on the image carrying surface is transported to a secondary transfer position facing the secondary transfer device 33 by rotating the intermediate transfer belt 31 in the direction indicated by the arrow B. On the other hand, in the paper feeding device 40, after the delivery device 42 delivers the recording paper 9 from the storage body 41 to the supply transport path RT1, the paper transport roller pair 43 supplies the recording paper 9 to the secondary transfer position of the intermediate transfer device 30. Then, at the secondary transfer position, the secondary transfer device 33 receives the supply of the secondary transfer bias and forms a secondary transfer electric field between the secondary transfer device 33 and the intermediate transfer belt 31, so that the toner images of four colors on the intermediate transfer belt 31 are secondarily transferred to one side of the recording paper 9.

Next, the recording paper 9 on which the unfixed toner image is secondarily transferred is transported so as to be delivered to the fixing device 50 via the relay transport path RT2 after being separated from the intermediate transfer belt 31. In the fixing device 50, the recording paper 9 is heated and pressurized when the recording paper 9 is introduced into and passed through the fixing processing unit which is a contact portion between the heating rotating body 52 and the pressurizing rotating body 53. With this configuration, the toner configuring the toner image is melted under pressure, and the toner image is fixed onto the recording paper 9.

Subsequently, the recording paper 9 after the toner image is fixed is output from the inside of a casing 51 of the fixing device 50, is transported via the output transport path RT3, and finally is output from a paper output port (not illustrated) to the outside.

By performing the operations described above, one recording paper 9 on which a full-color image is formed is output. When a request command for plural image forming operations is received, the image forming operation is repeatedly performed by the number of sheets in the same manner.

In addition, the image forming apparatus 1 can form a monochromatic image by operating any one of the four image forming devices 20 (Y, M, C, and K) or a color image other than a full-color image can be formed by operating two or three of the four image forming devices 20 (Y, M, C, and K) in combination, in the image forming operation.

Configuration of Feature Portions of Image Forming Apparatus

In the image forming apparatus 1 configured as described above, as illustrated in FIG. 3, in order to maintain color stability and the like of an image printed on the recording paper 9 constant, it is necessary to form the patch image 200 on the intermediate transfer belt 31, detect the patch image 200 by the density sensor 60, and accurately calculate the density of the patch image 200.

By the way, in order to detect the density of the patch image 200 formed on the intermediate transfer belt 31 by the density sensor 60, it is necessary to primarily transfer the patch images 200Y, 200M, 200C, and 200K of corresponding colors formed by the image forming devices 20 (Y, M, C, and K) of yellow (Y), magenta (M), cyan (C), and black (K) onto the intermediate transfer belt 31, and to detect the density of the patch image 200 by the density sensor 60 at the timing when the patch image 200 of each color of yellow (Y), magenta (M), cyan (C), and black (K) is moved to the position of the density sensor 60.

Figure 3:
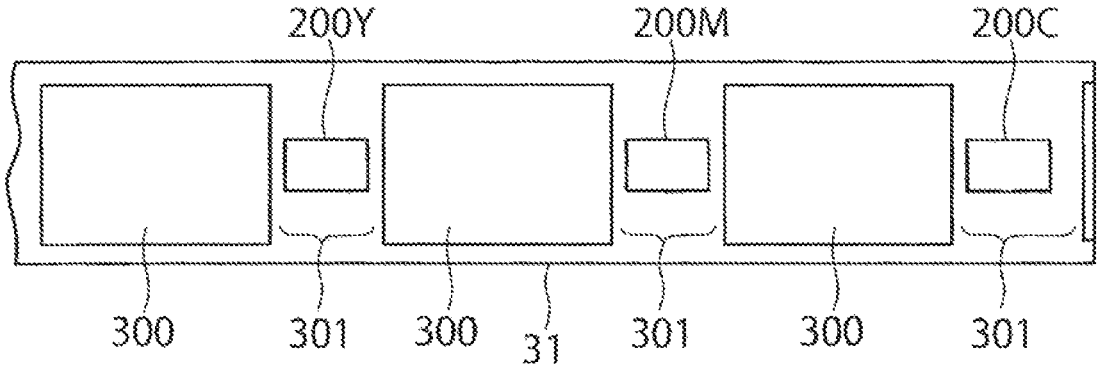
FIG. 3 is a planar configuration diagram illustrating patch images formed on an intermediate transfer belt.

In order to improve productivity which is the number of recording paper 9 on which an image can be printed per unit time in the image forming apparatus 1, as illustrated in FIG. 3, a configuration in which, while forming an image in an image area 300 set in advance on the intermediate transfer belt 31, the patch images 200Y, 200M, 200C, 200K of respective colors of yellow (Y), magenta (M), cyan (C), and black (K) are sequentially formed one by one in a non-image area 301 provided between two adjacent image areas 300 and the patch images 200Y, 200M, 200C, 200K are detected by the density sensor 60, is adopted.

The detection results of the patch images 200Y, 200M, 200C, and 200K by the density sensor 60 are used immediately for controlling the image density. For that reason, it is desirable to set the density of the patch image 200 to alternately change between the high density side and the low density side such that, as the patch images 200Y, 200M, 200C, and 200K of colors of yellow (Y), magenta (M), cyan (C), and black (K), for example, the first set of patch images 200Y, 200M, 200C, and 200K has an image density of Cin=80%, the second set of patch images 200Y, 200M, 200C, and 200K has an image density of Cin=40%, the third set of patch images 200Y, 200M, 200C, and 200K has an image density of Cin=60%, and the fourth set of patch images 200Y, 200M, 200C, and 200K has an image density of Cin=20%.

Figure 4A:
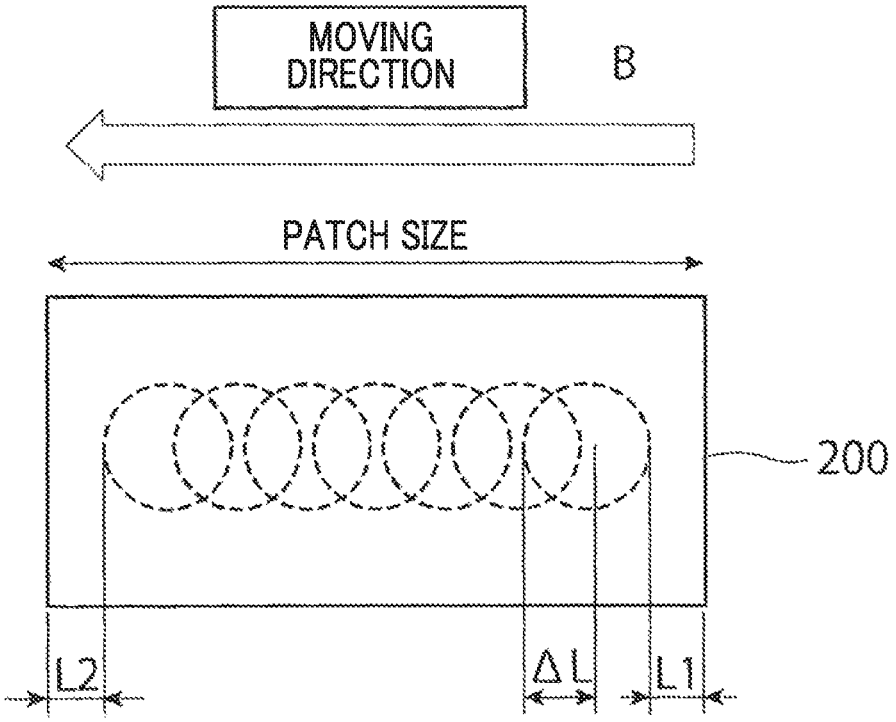
FIG. 4A and FIG. 4B are diagrams illustrating a detection state of the patch image in which the patch image is detected by a density sensor.

As illustrated in FIG. 4A, when detecting the density of the patch image 200, the density sensor 60 starts density detection from a detection start position positioned a predetermined distance L2 inward from a tip that is a downstream end of the patch image 200 in the moving direction B of the intermediate transfer belt 31, and detects the density of the patch image 200 at plural places (for example, about 20 to 30 points) at predetermined time intervals ΔT (corresponding to the distance ΔL).

In the first exemplary embodiment, as illustrated in FIG. 4A, the distance L2 from the downstream end of the patch image 200 in the moving direction B of the intermediate transfer belt 31 to the detection start position is shorter than in the related art and an upstream margin in the moving direction B of the intermediate transfer belt 31 of the patch image 200 is set relatively narrow. In the related art, the distance L2 from the downstream end of the patch image 200 in the moving direction B of the intermediate transfer belt 31 to the detection start position is set to be substantially the same as the detection area of the patch image 200. Incidentally, in the related art, the distance L1 from the upstream end of the patch image 200 in the moving direction B of the intermediate transfer belt 31 to the detection end position is also set to be substantially the same as the detection area of the patch image 200.

At this time, a shift may occur in the detection timing of the patch image 200 by the density sensor 60, for example, (i) there is a mounting error of which magnitude is a tolerance or greater at a mounting position of the density sensor 60 disposed on downstream of the image forming device 20K of black (K) in the moving direction B of the intermediate transfer belt 31 in the image forming apparatus 1, (ii) the control device 100 (see FIG. 5) that controls the detection timing at which the density sensor 60 detects the patch image 200 on the intermediate transfer belt 31 is affected by another program processing or noise, and the like.

Figure 4B:
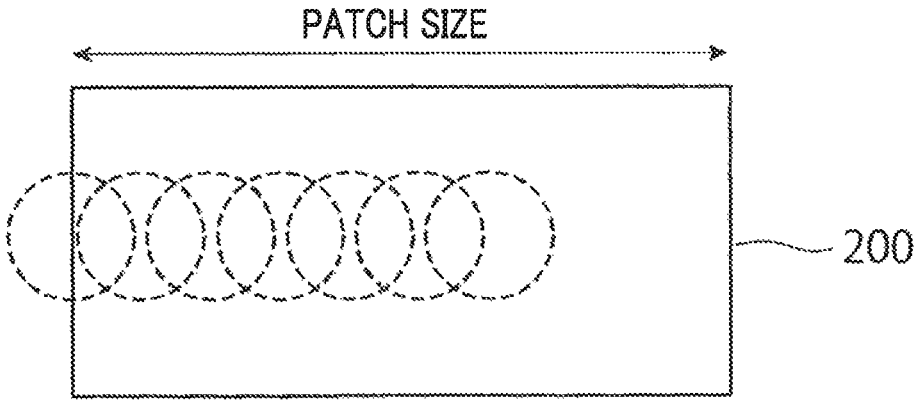

As described above, when the shift in the detection timing of the patch image 200 by the density sensor 60 occurs, as illustrated in FIG. 4B, in the case where the detection timing of the patch image 200 by the density sensor 60 deviates to the downstream in the moving direction B of the intermediate transfer belt 31 of the patch image 200, there is a possibility that the density of the patch image 200 cannot be accurately detected over plural predetermined detection places, such as erroneously detecting the surface of the intermediate transfer belt 31 other than the patch image 200 as the patch image 200.

The image forming apparatus 1 according to the first exemplary embodiment includes a determination unit that determines whether or not plural detection results of the density sensor 60 are within a predetermined threshold and a change unit. When the number of determination results, by the determination unit, that the density of the patch image is not within the threshold exceeds a predetermined number, the change unit changes (i) a detection timing at which the patch image 200 is detected by the density sensor 60 or (ii) a formation position of the patch image 200 on the intermediate transfer belt 31.

Configuration of Control Device

Figure 5:
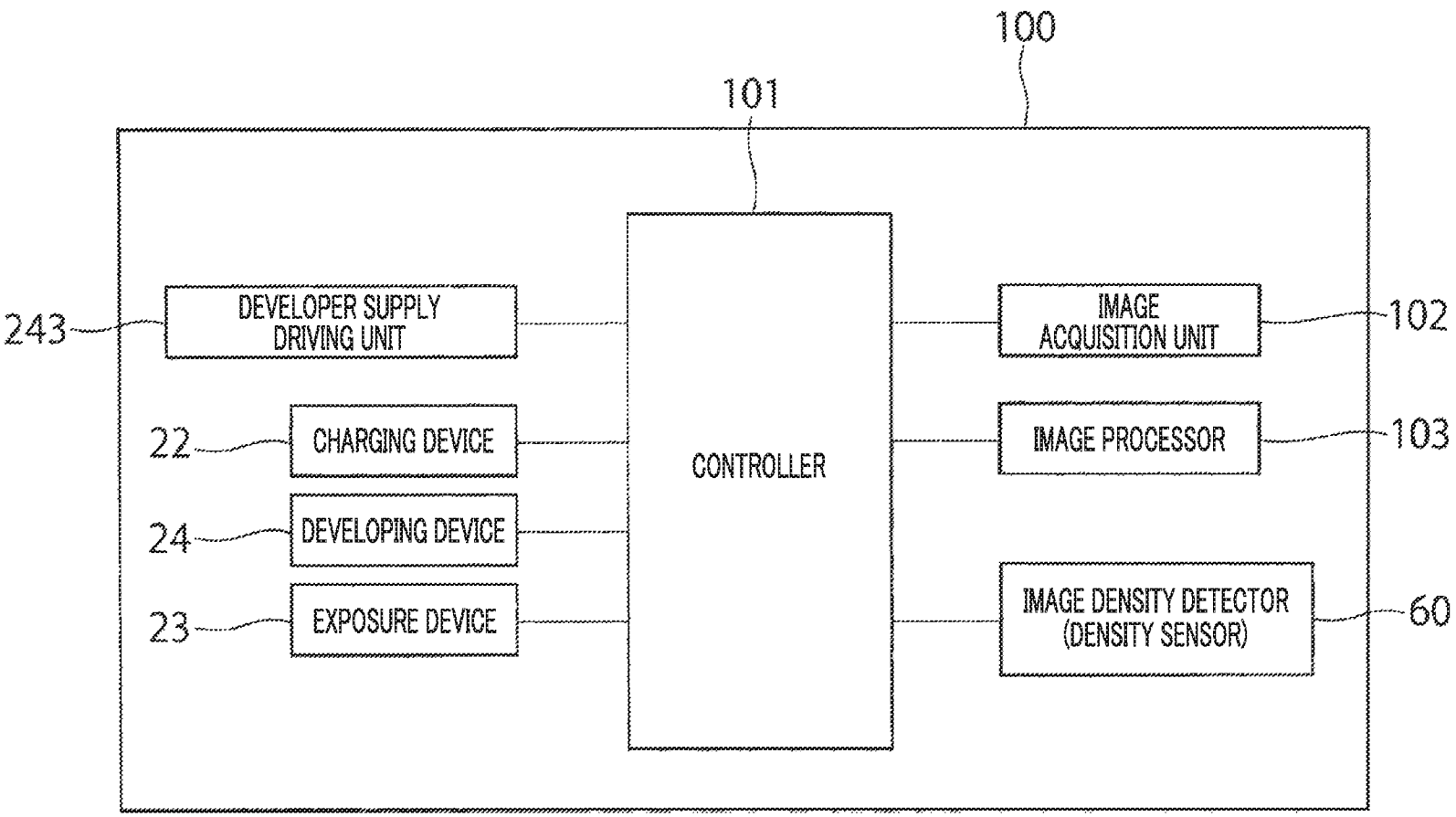
FIG. 5 is a block diagram illustrating a control device of the image forming apparatus according to the first exemplary embodiment of the present disclosure.

FIG. 5 is a block diagram illustrating a control device of the image forming apparatus according to the first exemplary embodiment.

A control device 100 includes a controller 101 that functions as an example of a determination unit and a change unit. The controller 101 comprehensively controls the operation of the image forming apparatus 1 including a control operation of an image density based on a detected density of the patch image 200 by executing a program stored in a storage (not illustrated). The controller 101 executes a forming operation of a color image and the like and a control operation of an image density by controlling a developer supply driving unit 243, the charging device 22, the exposure device 23, the developing device 24, and the like in each of the image forming devices 20 (Y, M, C, and K) of yellow (Y), magenta (M), cyan (C), and black (K).

The controller 101 is connected to an image acquisition unit 102 that acquires image information from outside and an image processor 103 that performs required image processing on the image information acquired by the image acquisition unit 102.

Density detection data of the patch image 200 is input to the controller 101 from the density sensor 60 as an image density detector.

When it is determined that it is the timing to execute the image density control operation, the controller 101 generates a timing signal for image density control. The timing at which the image density control operation is to be performed is, for example, when the power of the image forming apparatus 1 is turned on, when an image is printed on a predetermined number of recording paper 9, or when a jam occurs on the recording paper 9.

When the image density control timing signal is generated, the controller 101 outputs a patch generation signal for generating the patch image 200, and forms the patch image 200 of a corresponding color in each of the image forming devices 20 (Y, M, C, and K) of yellow (Y), magenta (M), cyan (C), and black (K). Although the patch image 200 of each color of yellow (Y), magenta (M), cyan (C) and black (K) is formed over plural densities, here, a case where the patch image 200 is formed with only one density will be described.

The controller 101 is configured the following manner. When the density sensor 60 detects the density of the patch image 200 of each color of yellow (Y), magenta (M), cyan (C), and black (K), the controller 101 determines whether or not plural detection results of the density sensor 60 are within a predetermined threshold. When it is determined that the number of the determination results that the density of the patch image is not within the threshold exceeds a predetermined number, the controller 101 changes (i) the detection timing at which the patch image 200 is detected by the density sensor 60 or (ii) the formation position of the patch image 200 on the intermediate transfer belt 31.

Operation of Feature Portions of Image Forming Apparatus

In the following manner, the image forming apparatus 1 according to the first exemplary embodiment secures the number of patch images effective for density detection even when the margin set before and after the detection area of the patch image is narrowed, as compared with a case where only the detection result of the central portion area is selected from among the detection results of the patch image stored in the storage unit based on the positional deviation amount of the patch image to calculate the image density of the patch image.

Figure 6:
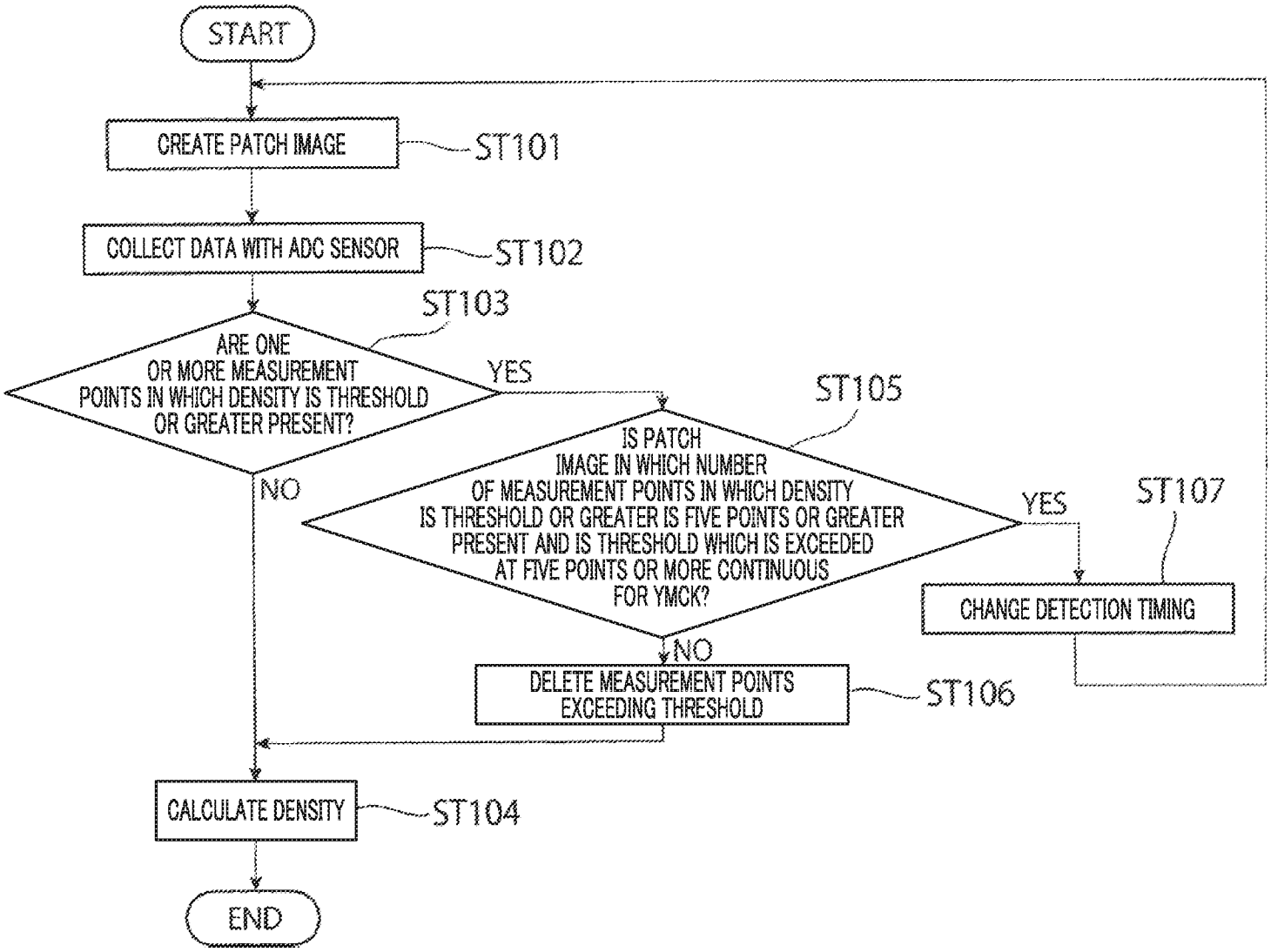
FIG. 6 is a flowchart illustrating an operation of the image forming apparatus according to the first exemplary embodiment of the present disclosure.

That is, in the image forming apparatus 1 according to the first exemplary embodiment, as illustrated in FIG. 6, when the controller 101 of the control device 100 determines that the timing is the control timing of the image density, the image density control operation is executed. In this image density control operation, an operation of creating a patch image 200 of each color of yellow (Y), magenta (M), cyan (C) and black (K), and an operation of detecting the patch image 200 of each color by the density sensor 60 and calculating the image density of the patch image 200 of each color are executed.

The controller 101 of the control device 100 creates the patch images 200Y, 200M, 200C, and 200K composed of toner images of the corresponding colors in the image forming devices 20 (Y, M, C, and K) of yellow (Y), magenta (M), cyan (C), and black (K) (step S101).

Next, the controller 101 detects densities of the patch images 200Y, 200M, 200C, and 200K of respective colors formed by the image forming devices 20 (Y, M, C, and K) of yellow (Y), magenta (M), cyan (C), and black (K) by the density sensor 60 and collect density data of the patch images 200Y, 200M, 200C, and 200K of respective colors (step S102).

Thereafter, the controller 101 determines whether or not there are one or more measurement points in which the density is a predetermined threshold or greater, based on the density data of the patch images 200Y, 200M, 200C, and 200K of respective colors (step S103). Here, determining whether or not there is a measurement point in which the density is a predetermined threshold or greater is made, as illustrated in FIG. 2, by detecting the densities of the patch images 200Y, 200M, 200C, and 200K by the density sensor 60 by detecting the specularly reflected light and the diffuse reflection light from the intermediate transfer belt 31 on which the patch images 200Y, 200M, 200C, and 200K are formed by the first and second light receiving elements 65 and 68. For that reason, this is because, when the density sensor 60 detects the surface of the intermediate transfer belt 31 without detecting the patch images 200Y, 200M, 200C, and 200K, the component of the specularly reflected light from the surface of the intermediate transfer belt 31 increases, and the output of the density sensor 60 deviates in the increasing direction. Here, instead of determining whether there is a measurement point in which the density is a predetermined threshold or greater, a configuration in which whether or not there is a measurement point in which the density is a predetermined first threshold or greater and in which the density is a predetermined second threshold or less is determined may also be adopted.

Figure 7A:
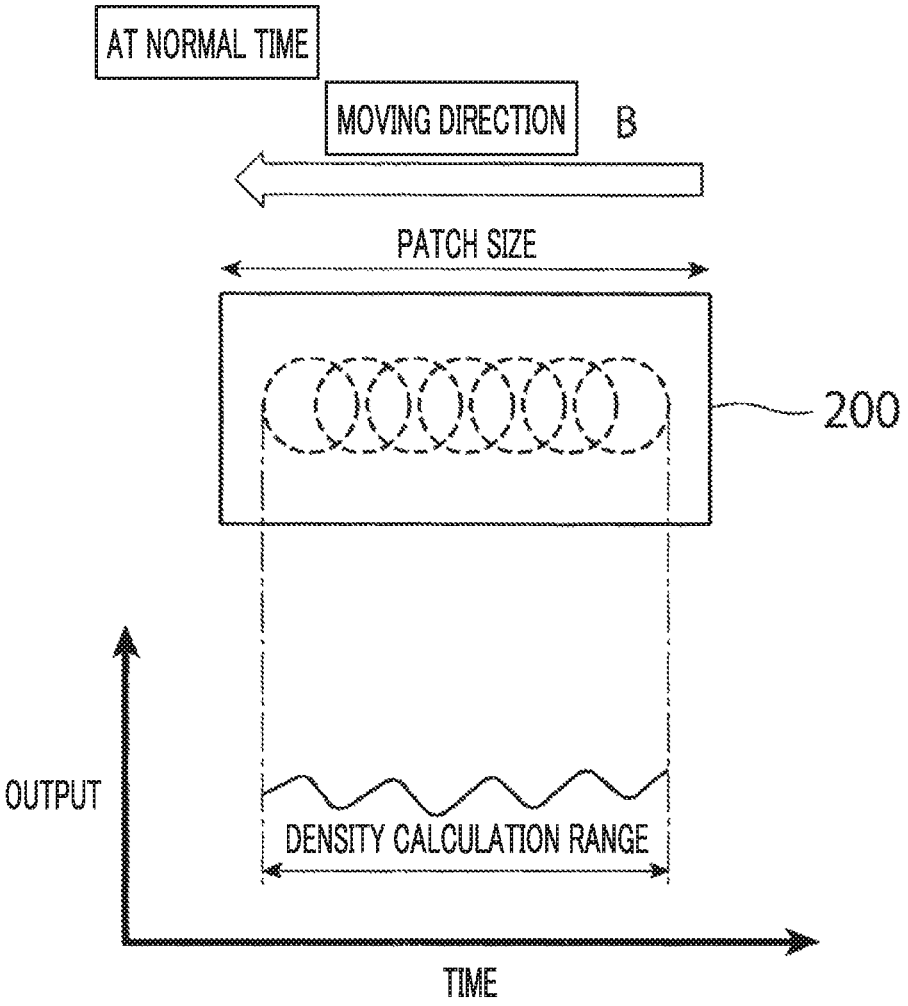
FIG. 7A and FIG. 7B are graphs illustrating an output of the density sensor together with a detection state of the patch image in which the patch image is detected by the density sensor.

As illustrated in FIG. 7A, when it is determined that there is no measurement point in which the density is the predetermined threshold or greater among the density data of the patch images 200Y, 200M, 200C, and 200K of respective colors and all of the measurement points are less than the predetermined threshold, the controller 101 calculates the image densities of the patch images 200Y, 200M, 200C, and 200K (step S104), and ends density calculation processing of the patch images.

The calculation of the image densities of the patch images 200Y, 200M, 200C, and 200K is performed by calculating an average value of the density data excluding the maximum value and the minimum value among the density data of the patch images 200Y, 200M, 200C, and 200K of respective colors.

Figure 7B:
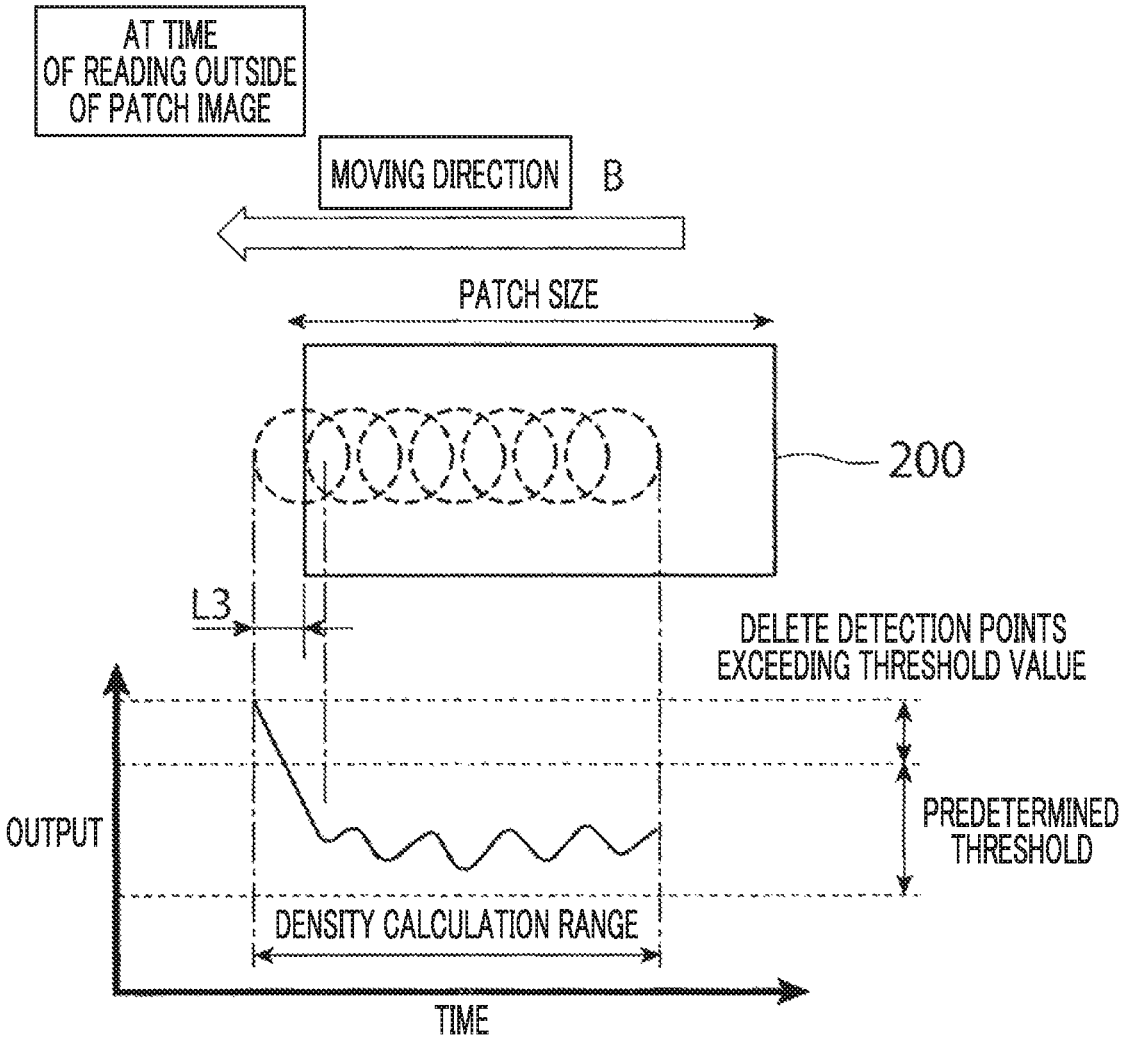

On the other hand, when it is determined that there is at least one measurement point in which the density is a predetermined threshold or greater among the density data of the patch images 200Y, 200M, 200C, and 200K of respective colors, as illustrated in FIG. 7B, the controller 101 determines whether or not the patch image in which the number of measurement points in which the density is the threshold or greater is five points or greater and the threshold is exceeded at five points or more is continuous for all colors of yellow (Y), magenta (M), cyan (C), and black (K) (step S105).

Then, when it is determined that the condition that the patch image in which the number of measurement points in which the density is the threshold or greater is five points or greater and the threshold is exceeded at five points or more is continuous for all colors of yellow (Y), magenta (M), cyan (C), and black (K) is not satisfied, the controller 101 deletes the density data of the measurement points in which the density is the threshold or greater (step S106), and calculates the image densities of the patch images 200Y, 200M, 200C, and 200K (step S104).

Here, the calculation of the image densities of the patch images 200Y, 200M, 200C, and 200K is performed by obtaining the average value of the other density data excluding the maximum value and the minimum value, as described above, after deleting the density data of the measurement points in which the density is the threshold or greater from among the density data of the patch images of respective colors. Here, the average value of the other density data may be immediately obtained without excluding the maximum value and the minimum value, after deleting the density data of the measurement points in which the density is the threshold or greater from among the density data of the patch images of respective colors.

When it is determined that the patch image in which the number of measurement points in which the density is the threshold or greater is five points and the threshold is exceeded at five points or more is continuous for all colors of yellow (Y), magenta (M), cyan (C), and black (K), the controller 101 executes processing for changing the detection timing of the patch images 200Y, 200M, 200C, and 200K (step S107).

Figure 8:
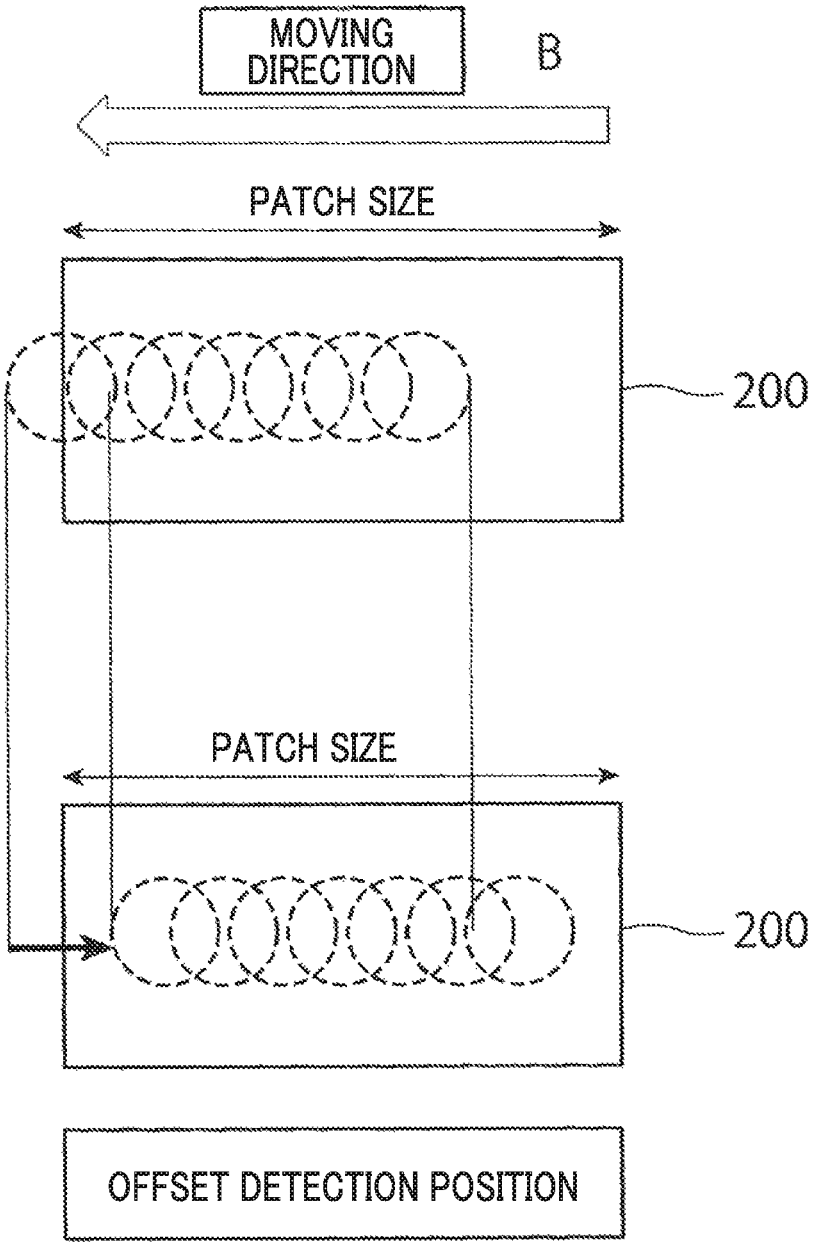
FIG. 8 is another diagram illustrating a detection state of a patch image in which the patch image is detected by the density sensor.

In the processing for changing the detection timing of the patch images 200Y, 200M, 200C, and 200K, as illustrated in FIG. 8, the controller 101 determines whether the detection timing of the patch images 200Y, 200M, 200C, and 200K deviates downstream or the upstream in the moving direction of the intermediate transfer belt 31, and detects a deviation amount of the detection timing of the patch images 200Y, 200M, 200C, and 200K as a time or a distance with respect to the moving speed of the intermediate transfer belt 31.

The direction in which the detection timings of the patch images 200Y, 200M, 200C, and 200K deviate and the deviation amount, as illustrated in FIG. 7B, are detected by the controller 101, for example, by analyzing whether the density data of the measurement point in which the density is the threshold or greater exists upstream or downstream in the moving direction B of the intermediate transfer belt 31, or analyzing the number of density data at the measurement point in which the density is the threshold or greater.

As illustrated in FIG. 7B, the controller 101 calculates a deviation amount L3 of the detection timing of the patch image 200 based on the analysis result of the position where the density data of the measurement points in which the density is the threshold or greater exists and the number of pieces of the density data of the measurement points in which the density is the threshold or greater, calculates a correction amount (L3+L2) of the detection timing of the patch image 200, and the like in consideration of the deviation amount L3 of the detection timing and margins L1 and L2 set upstream and downstream of the patch image 200 in the moving direction B of the intermediate transfer belt 31 such that the detection timing of the patch images 200Y, 200M, 200C, and 200K by the density sensor 60 falls within a required range of the patch image, and executes the processing for changing the detection timing of the patch images 200Y, 200M, 200C, and 200K based on the correction amount (L3+L2) of the detection timing (step S107).

In this case, as illustrated in FIG. 8, the controller 101 executes processing for changing the detection timing of the patch images 200Y, 200M, 200C, and 200K so that the detection timing is delayed by a time corresponding to the deviation amount (L3+L2).

The controller 101 may be configured to change the formation position of the patch images 200Y, 200M, 200C, and 200K on the intermediate transfer belt 31 instead of changing the detection timing of the patch images 200Y, 200M, 200C, and 200K by the density sensor 60.

In this case, the controller 101 may change the formation positions of the patch images 200Y, 200M, 200C, and 200K in the image forming devices 20 (Y, M, C, and K) of yellow (Y), magenta (M), cyan (C), and black (K) to the downstream in the moving direction of the intermediate transfer belt 31.

After that, the controller 101 returns to step S101, executes an operation of creating the patch images 200Y, 200M, 200C, and 200K from the toner images of the corresponding colors in the image forming devices 20 (Y, M, C, and K) of yellow (Y), magenta (M), cyan (C), and black (K), detects the patch images 200Y, 200M, 200C, and 200K at the changed detection timing by the density sensor 60 and collects density data (step S102), and executes processing for calculating the image densities of patch images 200Y, 200M, 200C, and 200K (step S104).

After that, based on the calculated image density of the patch image, the controller 101 executes an operation for controlling the image density to be in an appropriate range in the image forming devices 20 (Y, M, C, and K) of yellow (Y), magenta (M), cyan (C), and black (K).

As described above, with the image forming apparatus 1 according to the first exemplary embodiment, even when a margin set before and after a detection area of the patch image 200 is narrowed, the number of patch images effective for density detection can be secured by changing (i) the detection timing at which the patch image 200 is detected by the density sensor 60 or (ii) the formation position of the patch image 200 on the image forming device when the number of the determination results, by the determination unit, that the density of the patch image is not within the predetermined threshold exceeds the predetermined number, as compared with the case where only the detection result of the central portion area is selected from among the detection results of the patch image stored in the storage unit from the positional deviation amount of the patch image and the image density of the patch image is calculated.

Second Exemplary Embodiment

Figure 9:
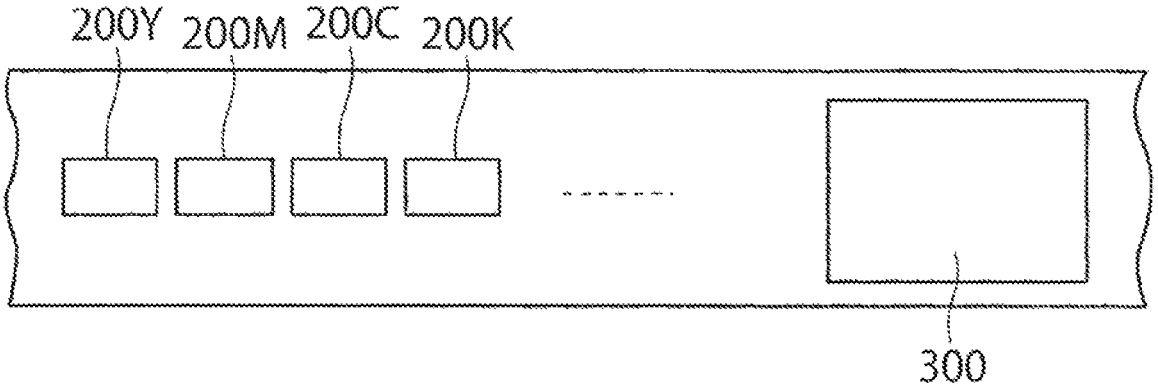
FIG. 9 is a planar configuration diagram illustrating patch images formed on an intermediate transfer belt of an image forming apparatus according to a second exemplary embodiment of the present disclosure.

FIG. 9 illustrates an image forming apparatus according to a second exemplary embodiment. The image forming apparatus according to the second exemplary embodiment is configured such that the density detector detects the density of the patch image before the start of the image forming operation.

That is, in the image forming apparatus 1 according to the second exemplary embodiment, as illustrated in FIG. 9, a configuration in which the patch images 200Y, 200M, 200C, and 200K of yellow (Y), magenta (M), cyan (C) and black (K) of the corresponding colors are continuously formed in the image forming devices 20 (Y, M, C, and K) prior to the image forming operation and the density of the patch images 200Y, 200M, 200C, and 200K is detected by the density sensor 60 is adopted.

As described above, by continuously forming the patch images 200Y, 200M, 200C, and 200K prior to the normal image forming operation and detecting the density of the patch images 200Y, 200M, 200C, and 200K by the density sensor 60, image quality of the initially formed image can be improved as compared with the case where the density detection of the patch images 200Y, 200M, 200C, and 200K by the density sensor 60 is performed between plural image areas 300 formed by the image forming operation.

Other configurations and operations are the same as those in the first exemplary embodiment, and thus description thereof will be omitted.

Third Exemplary Embodiment

Figure 10:
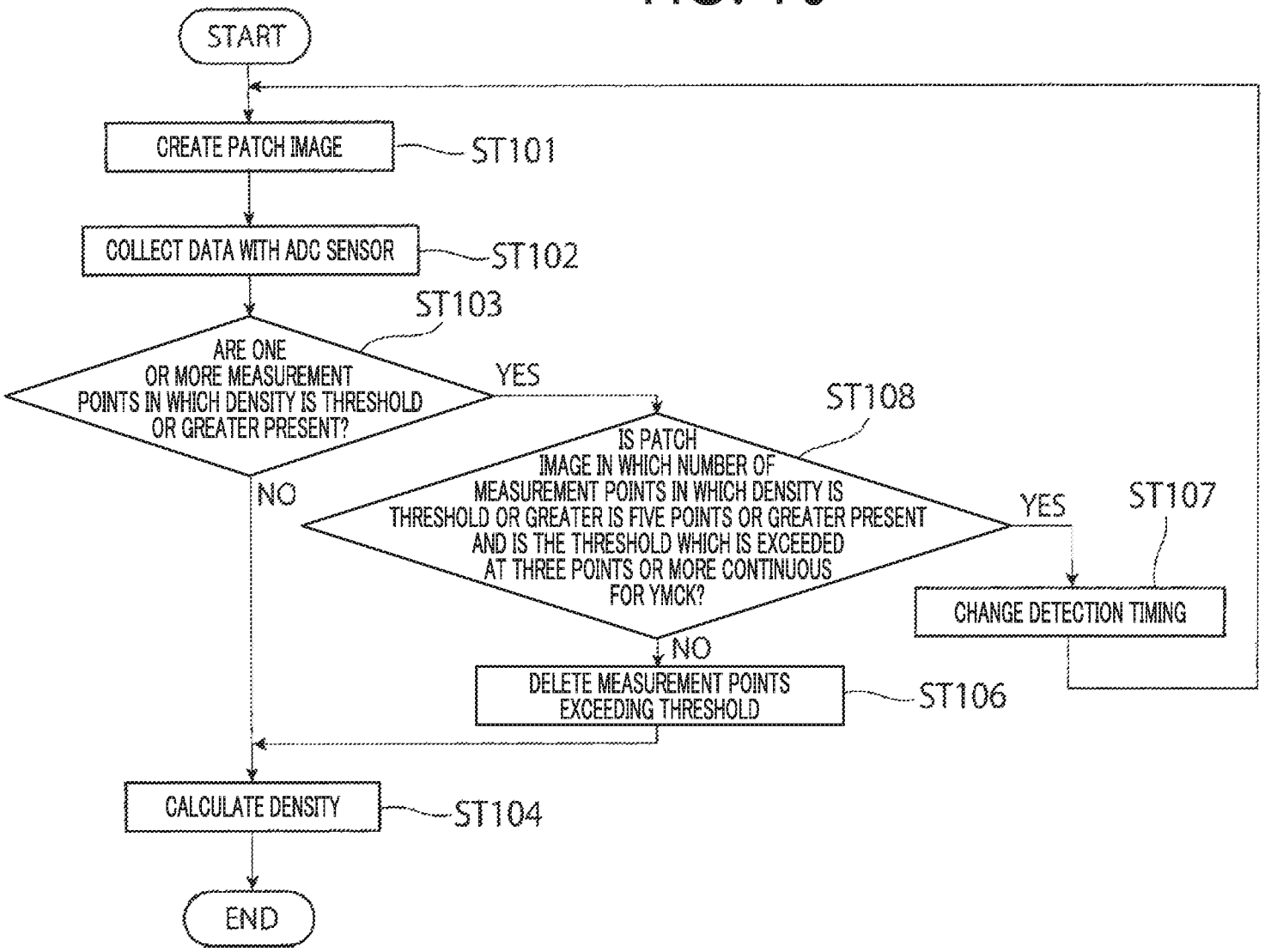
FIG. 10 is a flowchart illustrating an operation of an image forming apparatus according to a third exemplary embodiment of the present disclosure.

FIG. 10 illustrates an image forming apparatus according to a third exemplary embodiment. The image forming apparatus 1 according to the third exemplary embodiment is configured such that the operation after the controller 101 determines whether there are one or more measurement points in which the density is a predetermined threshold or greater based on the density data of the patch images 200Y, 200M, 200C, and 200K of respective colors is different from that of the first exemplary embodiment described above.

That is, in the image forming apparatus 1 according to the third exemplary embodiment, as illustrated in FIG. 10, after the controller 101 determines whether there is one or more measurement points in which the density is a predetermined threshold or greater based on the density data of the patch images 200Y, 200M, 200C, and 200K of respective colors (step S103), when it is determined that among the density data of the patch images 200Y, 200M, 200C, and 200K of each color, at least one measurement point in which the density is the predetermined threshold or greater is determined, the controller 101 determines whether or not the patch image in which the number of measurement points in which the density is the threshold or greater is five points or greater and the threshold is exceeded at three points or more is continuous for all colors of yellow (Y), magenta (M), cyan (C), and black (K) (step S108).

Accordingly, the controller 101 is configured to proceed to step S107 and change the detection timing when five or more measurement points in which the density is the threshold or greater exist among the density data of the patch images 200Y, 200M, 200C, and 200K of respective colors, or when the patch image in which the threshold is exceeded at three points or more is continuous for all colors of yellow (Y), magenta (M), cyan (C), and black (K).

As such, in the third exemplary embodiment, the controller 101 changes the detection timing when five or more measurement points in which the density is the threshold or greater exist among the density data of the patch images 200Y, 200M, 200C, and 200K of respective colors, or when the patch image in which the threshold is exceeded at three points or more is continuous for all colors of yellow (Y), magenta (M), cyan (C), and black (K).

For that reason, in the third exemplary embodiment, under severe condition when five or more measurement points in which the density is the threshold or greater exist even in the density data of the patch images 200Y, 200M, 200C, and 200K of one color, or when the patch image in which the threshold is exceeded at three points or more is continuous for all colors of yellow (Y), magenta (M), cyan (C), and black (K), it is possible to maintain the detection accuracy of the patch images 200Y, 200M, 200C, and 200K while allowing the margin of the patch images 200Y, 200M, 200C, and 200K to be reduced, by changing the detection timing of the patch images 200Y, 200M, 200C, and 200K.

Other configurations and operations are the same as those in the first exemplary embodiment, and thus description thereof will be omitted.

In the exemplary embodiments described above, although a full-color image forming apparatus including the image forming devices 20 (Y, M, C, and K) of yellow (Y), magenta (M), cyan (C), and black (K) has been described as an image forming apparatus, it is needless to say that image forming apparatus can be similarly applied to a monochrome image forming apparatus.

In the exemplary embodiments described above, the electrophotographic image forming apparatuses have been described. The present disclosure is applicable to image forming apparatuses other than electrophotographic ones. For example, the present disclosure may be applied to an inkjet image forming apparatus. More specifically, the present disclosure may be applied to an image forming apparatus that draws an ink image on an intermediate transfer body with an ink ejection head and transfers the ink image from the intermediate transfer body to paper.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a density detector that detects a density of a patch image formed on an image carrier over a plurality of places;

a determination unit that determines whether a plurality of detection results of the density detector are within a threshold; and a change unit wherein when the number of determination results, by the determination unit, that the density of the patch image is not within the threshold exceeds a predetermined number, the change unit changes (i) a detection timing at which the patch image is detected by the density detector or (ii) a formation position of the patch image on the image carrier.

2. The image forming apparatus according to claim 1, wherein when the number of the determination results, by the determination unit, that the density of the patch image is not within the threshold does not exceed the predetermined number, neither (i) the detection timing at which the patch image is detected by the density detector nor (ii) the formation position of the patch image on the image carrier is changed.

3. The image forming apparatus according to claim 2, wherein when the number of the determination results, by the determination unit, that the density of the patch image is not within the threshold does not exceed the predetermined number, the density of the patch image is calculated excluding detection results of the patch image for which the determination unit determines that the density of the patch image is not within the threshold.

4. The image forming apparatus according to claim 1, wherein the determination unit identifies a position of the patch image for which it is determined that the detection result of the density detector is not within the predetermined threshold, and the change unit changes (i) the detection timing at which the patch image is detected by the density detector or (ii) the formation position of the patch image on the image carrier such that the patch image which is identified by the determination unit and for which it is determined that the detection result is not within the predetermined threshold is within a detection area of the density detector.

5. The image forming apparatus according to claim 1, wherein the determination unit identifies a position of the patch image for which it is determined that the detection result of the density detector is not within the predetermined threshold, and the change unit performs change such that the patch image which is identified by the determination unit and for which it is determined that the detection result is not within the predetermined threshold is within a detection area of the density detector.

6. The image forming apparatus according to claim 1, wherein the density detector detects the density of the patch image between a plurality of image areas formed by an image forming operation.

7. The image forming apparatus according to claim 6, wherein the change unit changes the detection timing at which the patch image is detected by the density detector between the plurality of image areas.

8. The image forming apparatus according to claim 1, wherein the density detector detects the density of the patch image before an image forming operation is started.

9. An image forming apparatus comprising:

density detecting means for detecting a density of a patch image formed on an image carrier over a plurality of places;

determining means for determining whether a plurality of detection results of the density detecting means are within a threshold; and changing means for, when the number of determination results, by the determining, that the density of the patch image is not within the threshold exceeds a predetermined number, changing (i) a detection timing at which the patch image is detected by the density detecting means or (ii) a formation position of the patch image on the image carrier.

* * * * *